US005176367A

United States Patent [19]

Rodgers et al.

[11] Patent Number: 5,176,367

[45] Date of Patent: Jan. 5, 1993

[54] STACKABLE SPRING ASSEMBLIES WITH FORMED WIRE SPRING MODULES

[75] Inventors: William C. Rodgers; Arval W. Barnes, Sr., both of Lexington, Ky.

[73] Assignee: Hoover Group, Inc., Alpharetta, Ga.

[21] Appl. No.: 656,585

[22] Filed: Feb. 19, 1991

[51] Int. Cl.[5] ..... A47C 23/00

[52] U.S. Cl. ..... 267/103; 5/247; 5/255

[58] Field of Search ..... 5/247, 255, 257, 263, 5/268, 476; 267/80, 85, 103, 144

[56] References Cited

U.S. PATENT DOCUMENTS

| | | | |
|---|---|---|---|
| 4,703,527 | 11/1987 | Mizelle | 5/247 |
| 4,739,977 | 4/1988 | Dabney | 267/103 |
| 4,838,528 | 6/1989 | Hagemeister | 5/255 |
| 4,896,386 | 1/1990 | Ogle et al. | 5/247 |

*Primary Examiner*—Robert J. Oberleitner
*Assistant Examiner*—Chris Schwartz
*Attorney, Agent, or Firm*—Harness, Dickey & Pierce

[57] ABSTRACT

A spring assembly for bedding and furniture which includes a rectangular support frame and a grid unit disposed above and in general vertical alignment with the frame, the grid unit including a border wire and cross wires arranged in a criss-cross pattern on said border wire. A plurality of upright formed wire springs modules are arranged in a predetermined pattern on the grid unit and supported on said frame. Some of the modules constitute main springs which are attached in a clipless manner at the upper ends thereof to the grid unit so as to be connected to the grid unit in a manner such that loads on the grid unit are yieldably resisted by the main springs. Others of the spring modules are corner springs located at the corners of the frame. The corner springs are similar to the main springs but are secured by conventional clips to the corners of the border wire in the grid unit. Each of the spring modules is of one-piece wire construction and is of downwardly tapered shape to enable grid and spring module assemblies to be efficiently arranged in compact nested stacks for shipping and storage.

3 Claims, 4 Drawing Sheets

STACKABLE SPRING ASSEMBLIES WITH FORMED WIRE SPRING MODULES

CROSS REFERENCE TO RELATED APPLICATION

This application relates to the invention shown in copending application Ser. No. 628,086, filed Dec. 17, 1990, entitled Nestable Spring Assemblies for Bedding and Furniture and assigned to the assignee of this application.

BACKGROUND AND SUMMARY

This invention relates generally to spring assemblies for bedding and furniture foundations for mattresses and seat cushions. Such spring assemblies conventionally consist of a support frame, a wire grid positioned above the support frame, and springs supporting the grid on the frame for yieldable movement under load toward the frame.

Spring assemblies of this type now in use are satisfactory. They consist of metal components such as the springs and the grid and in some cases the frame which are supplied to the bedding or furniture manufacturer for assembly and ultimate sale. In the case of box spring assemblies, various sizes and grades of box spring assemblies are made by the manufacturer and this requires the maintenance by the furniture manufacturer of a large inventory of metal components. There are, therefore, opportunities for improving such spring assemblies particularly from the standpoint of ease of assembly and ease of converting from one grade or size to another.

It is an object of the present invention, therefore, to provide spring assemblies that can be readily assembled with fewer of the usual clips for connecting springs and grids and which teaches the adaptation of a formed wire, limited deflection spring module to a stackable spring assembly system, to thereby accomplish economy of wire, economy of shipping, ease of assembly to a wood frame and versatility of spring patterns. The present invention is thus an improvement on the invention disclosed in the above application.

It is also an object to provide a spring assembly that can be economically preassembled and nested in compact stacks that can readily be shipped by the manufacturer of the metal grids and springs without danger of shifting or entanglement of parts during transit or storage. Each spring assembly consists of a grid unit and a predetermined number of spring modules connected to the grid unit.

In this invention, economy of wire is accomplished with a geometrically unique main spring of "formed wire type". It has a "V" formed base with dual column support on the frame to prevent spring collapse under load. Full spring element deflection is limited to approximately 2½" which has previously been established as optimum for useful surface dynamics. Stable column support, as displayed in this invention, prevents system failure when shock loads are applied. Previous stackable spring assemblies have been of non-limited deflection design.

The present invention allows nested bundles of 100 spring assemblies or more that can be palletized and stacked in what ever height and configuration is best suited to the transit vehicle. This is possible because the contact points, between nested assemblies, become more stable when the weight of additional assemblies is applied. These then form a series of support columns, in a "honeycomb" fashion, that distribute and stabilize additional stacks and prevent entanglement of nests.

Another feature of the current invention is a formed wire corner spring that incorporates all the features of the described formed wire main spring, with changes made to the bar, lever and mounting geometry to provide optimum platform support and upholstery support unique to the corners of the unit.

Because the spring assemblies are shipped preassembled in virtually solid stacks, a larger number of completed spring assemblies can be shipped (approximately 2,800-3,000/Truckload) than previous knockdown type box spring assemblies (approximately 2,200-2,500) where grids and springs are shipped in separate bundles and cartons for subsequent assembly. Further the spring assemblies of this invention are ready to attach to the wood frame, upon arrival to the customer, with no sub-assembly operations required.

It is a further object of this invention to provide a spring assembly which includes a spring module that can readily be adapted to the manufacture of spring assemblies in a variety of sizes and a variety of spring densities in the assembly.

Further objects, features and advantages of the invention will become apparent from a consideration of the following description and the appended claims when taken in connection with the accompanying drawing.

DETAILED DESCRIPTION

Figure 1:
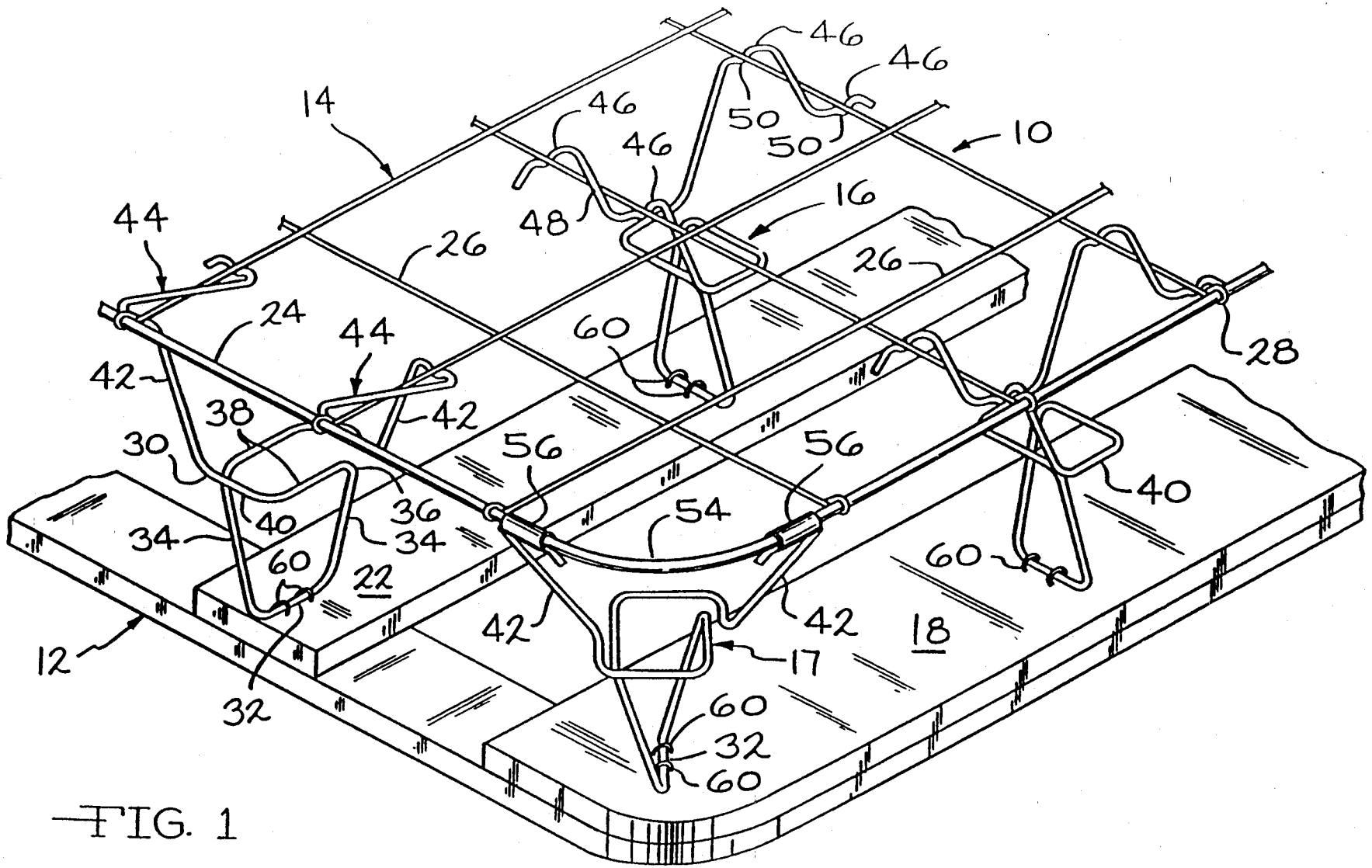
FIG. 1 is a fragmentary perspective view of the spring assembly of this invention mounted on a box spring frame.

With reference to the drawing, the spring assembly of this invention, indicated generally at 10, is illustrated in FIG. 1 mounted on a supporting frame 12, only a portion of which is illustrated but which is of generally rectangular shape. The assembly 10 consists of a wire grid unit 14, also of rectangular shape, which is positioned above and in a general alignment with the frame 12 and a plurality of main spring modules 16 and corner spring modules 17 which are attached to the wire grid unit 14. When the spring modules 16 are mounted on the frame 12, they act to support the grid unit 14 at a predetermined elevation above the frame 12.

The frame 12 consists of a pair of end rails 18, a pair of side rails 20, and a plurality of cross rails 22. The frame 12 is conventional so only one of each of the rails is illustrated in FIG. 1. The wire grid unit 14 consists of a rectangular border wire 24 and(a plurality of grid wires 26 which are arranged in a criss-cross fashion and are supported on the border wire 24. In the illustrated embodiment of the grid unit 14, the cross wires 26 are illustrated as having return bent portions forming loops 28 at their ends which are bent around the border wire in order to support the cross wires on the border wire 24. In the preferred embodiment shown in FIG. 1 the cross wires 26 are substantially straight without bends.

Figure 4:
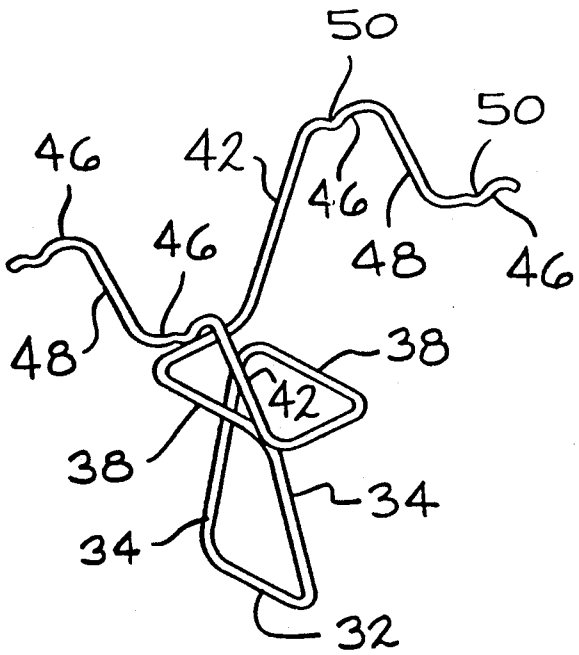
FIG. 4 is a perspective view of a main spring module in the spring assembly of this invention.

The spring modules 16 (FIGS. 4 and 5) are identical, each comprising a body 30 formed of a single piece of conventional spring wire and folded, in the preferred embodiment of this invention to be generally V-shaped. The V-shaped spring body 30 is generally upright and has a support bar 32 at its lower end or apex. A pair of straight upwardly diverging columns 34 extend upwardly from opposite ends of the bar 32 and are formed integral at their upper ends 36 with oppositely extending generally parallel torsion bars 38. The torsion bars 38 are formed integral with generally horizontal connecting bars 40 which terminate in upwardly diverging support arms 42.

At its upper end, the body 30 is formed with a pair of horizontally spaced apart attaching portions 44 which constitute the ends of the body 30 before folding and are integral with the support arms 42. The attaching portions 44 are configured so that they can be interfitted with adjacent parallel grid wires 26 so as to provide for a clipless attachment of the upper end of the main spring module 16 to the grid 14. As a result, the springs 16 are connected to the grid 14 so that up and down movement of the grid 14 in response to bedding loads results in corresponding substantially vertical compression and expansion of the springs 16 in reaction to the loads.

Each of the attaching portions 44 includes a pair of spaced apart generally parallel clamping bars 46 which extend transversely of a grid wire 26, and are disposed against the bottom side of the grid wire 26. A connecting bar 48 extends diagonally between opposite ends of each pair of clamping bars 46 and maintains the clamping bars 46 in firm engagement with the bottom sides of the grid wire 26. Each of the clamping bars 46 is bent intermediate its ends so as to form an upwardly facing notch 50 engageable with the underside of the grid wire 26 so a to stabilize the position of the clamping bar 46 on the grid wire 26. This in turn maintains the spring modules 16 in stable positions on the grid unit 14.

The corner spring modules 17 are similar to the main spring modules 16 and are identical to the modules 16 in the portion of each corner spring module 17 between the lower support bar 32 and the upper support arms 42. Accordingly, like numerals are used on the corner spring modules 17 to indicate like parts on the main spring modules 16. At their upper ends, the support arms 42 in the corner spring modules are formed with attaching bars 52, instead of the attaching portions 44 utilized in the main spring modules 16. The attaching bars 52 in each corner spring module 17 are generally perpendicular to each other and extend generally toward each other. This configuration of the attaching bars 52 enables them to be positioned in a side-by-side relation with the border wire 24 at a corner 54 of the border wire 24, as shown in FIG. 1. Conventional spring clips 56 are utilized to clamp the attaching bars 52 to the side-by-side portions of the border wire 24 and assure a stable position of the corner spring module 17 at a corner 54 of the border wire 24.

Figure 2:
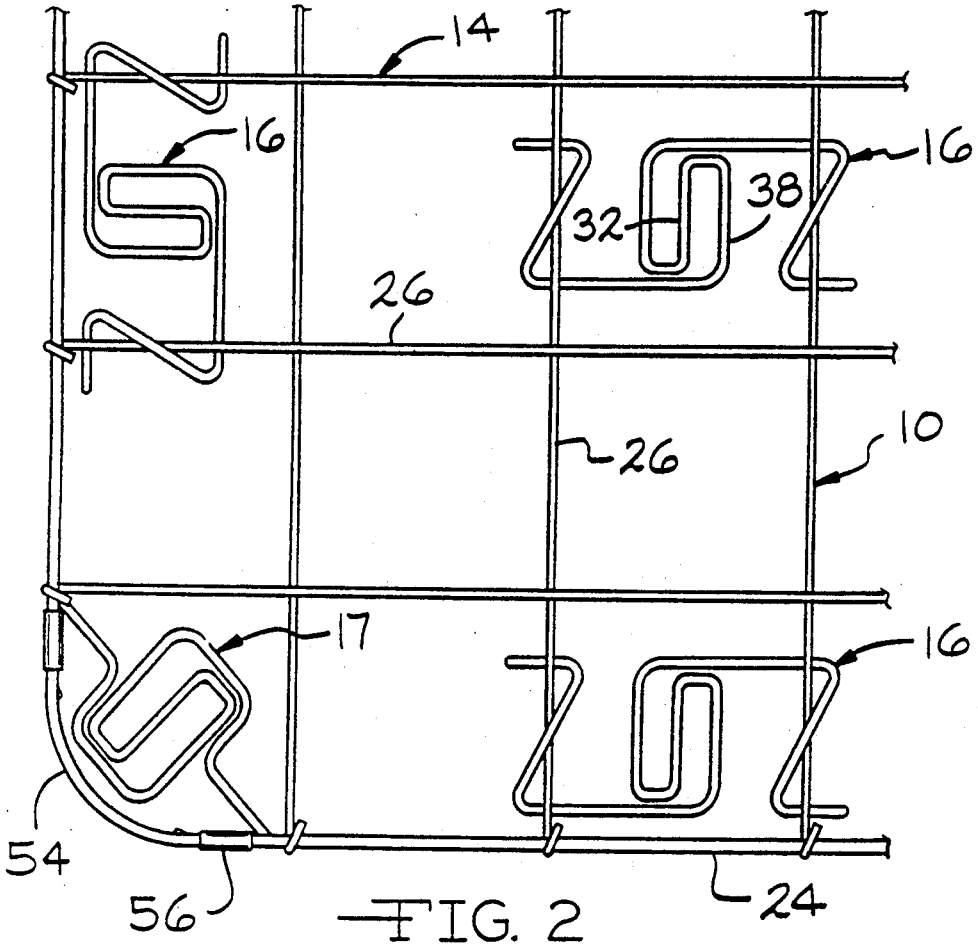
FIG. 2 is a fragmentary top plan view of the spring assembly of this invention.

From the above description, it is seen that a spring assembly 10 is formed by assembling a plurality of main spring modules 16 with the wire grid 14, the exact number of spring modules 16 to be used being dependent entirely on the assembler. The number to be used depends on the desired spring firmness of the assembly, the cost of the assembly, and other design considerations such as the particular locations in the grid unit 14 at which spring resistance is desired. As shown in FIG. 2, the main spring modules 16 can be arranged so that they are generally perpendicular to each other, for a purpose to appear presently.

Figure 3:
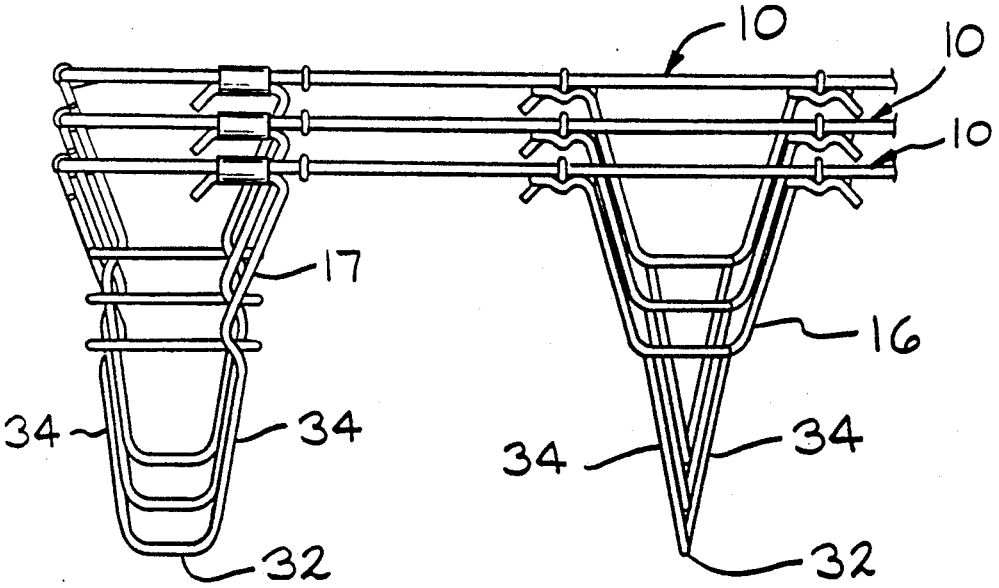
FIG. 3 is a fragmentary transverse sectional view of a nested stack of preassembled spring assemblies of this invention.

At the corners of the grid unit 14, corner spring modules 17 are clipped to the border wire 24. Large numbers of identical assemblies 10 can then be arranged in vertical stacks, as shown in FIG. 3. This is made possible by the generally downwardly tapering shape of the spring modules 16 and 17 with the upwardly diverging columns 34 providing this downwardly tapering configuration. The "V" configuration formed by the columns 34 at the lower end of each spring module prevents collapse of the column support provided for the grid unit 14. The stable column support provided by the columns 34 prevents failure of the spring assembly when shook loads are applied.

If desired, nested bundles of assemblies 10 can be palletized and stacked to whatever height and configuration is best suited to the particular transportation mode that is being utilized. As shown in FIG. 3, the support bars 32 in nested assemblies 10 are in substantial engagement with each other so that practically no vertical space is wasted in a stack of assemblies 10. Furthermore, the fact that some of the spring modules extend at right angles to others of the spring modules, as shown in FIG. 2, prevents relative shifting movement between assemblies 10 in the stack. The result is assemblies 10 that can be economically manufactured and transported to a desired upholstery site at which they are mounted on frames 12. As shown in FIG. 1, such assembly requires only placement of the spring support bars 32 on the frame rails 18 and 22 and subsequent securing of the bars 32 to the frame by means of staples 60.

Figure 5:
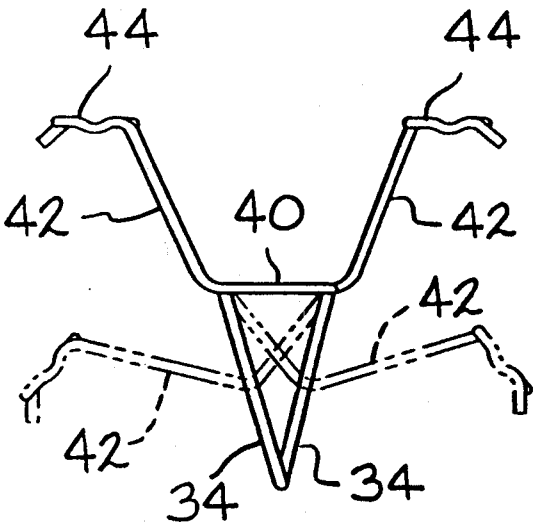
FIG. 5 is an elevational view of the main spring module showing the spring in a maximum deflection (limited) in broken lines.
Figure 7:
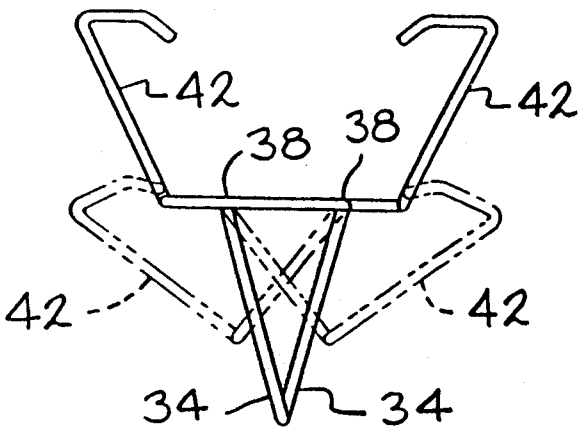
FIG. 7 is an elevational view of the corner spring showing the spring in a maximum deflection (limited) in broken lines.
Figure 6:
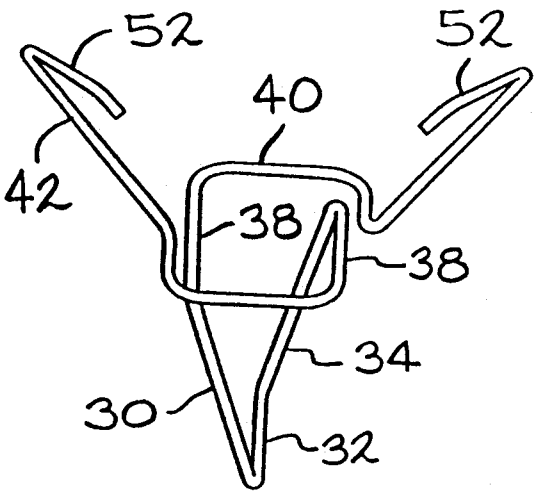
FIG. 6 is a perspective view of a corner spring module in spring assembly of this invention.

The spring modules 16 and 17 are illustrated in their fully deflected positions in FIGS. 5 and 7 in broken lines. As shown, the springs are limited deflection springs in the sense that they will not deflect far enough to allow the grid unit 14 to engage the frame 12. The columns 34 are stable and will not deflect. The support arms 42 can only deflect until they engage or nearly engage the columns 34 at which position, the spring attaching portions 44 and 52 are at substantially the level of the torsion bars 38. During normal use, the torsion bars 38 cooperate with other portions of the spring bodies 30 to resiliently resist bedding loads applied to the wire grid unit 14 so as to provide the desired comfort to the user of the bedding that is supported on the foundation represented by the spring assembly 10 and the frame 12.

From the above description it is seen that this invention provides an improved spring assembly 1 which effectively accomplishes its desired purpose in a bedding foundation in an economical manner.

We claim:

1. For use in foundation assemblies, a vertically extending stack of identical articles of manufacture in which each article in the stack comprises a grid unit of generally rectangular shape having a border wire and a plurality of spaced apart grid wires supported on said border wire and arranged in a criss-cross relation defining rectangular openings between adjacent spaced apart grid wires, and a plurality of upright spring modules arranged in a predetermined pattern on said grid unit and extending downwardly therefrom, at least one of said spring modules including means at the upper end thereof arranged in interfitting engagement with said grid unit so as to support the spring module on the grid unit, said spring module being a one-piece wire member folded to form a formed wire spring having torsion bars for resisting bedding loads and downwardly tapering substantially straight column sections that terminate and are formed integral at their bottom ends with a mounting support bar that is generally horizontal, said downwardly tapering body terminating in said support bar for functioning to guide the downward movement of one of said articles of manufacture into a nested position relative to another article of manufacture aligned therebelow to thereby enable a plurality of said articles of manufacture to be arranged in said vertically extending stack in which the spring modules on each grid unit are nested downwardly into the spring modules immediately therebelow in said stack;

said support means at the upper end of said at least one spring module including first and second spaced apart attaching portions, each of said attaching portions engaging and being interfitted to adjacent spaced grid cross wires with each attaching portion engaging a single grid cross wire whereby said spring module bottom end extends downwardly and below said adjacent spaced grid cross wires, each of said attaching portions including a pair of spaced substantially parallel clamping bars extending transversely of one grid cross wire and a connecting bar extending diagonally between opposite ends of said clamping bars, said clamping bars and said connecting bar being engaged with vertically opposite sides of said one grid cross wire so as to mount said at least one spring module on said grid unit.

2. The article of manufacture according to claim 1 further including corner spring modules each of which terminates at its upper end in attaching portions arranged in a side-by-side relation with said border wire, and clip means securing said attaching portions to said border wires.

3. The article of manufacture of claim 1 wherein said grid wires have return bent portions forming loops at their ends which are bent around said border wire and between said return bent portions said grid wires are substantially straight without bends.

* * * * *